US008155540B2

(12) United States Patent
Bichkar

(10) Patent No.: US 8,155,540 B2
(45) Date of Patent: Apr. 10, 2012

(54) OPTIMIZED LIMIT GAIN COMPENSATION FOR DISPENSE TIME ACCUMULATORS OF TONER CONCENTRATION CONTROL

(75) Inventor: Akshay Bichkar, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/792,052

(22) Filed: Jun. 2, 2010

(65) Prior Publication Data

US 2011/0299863 A1 Dec. 8, 2011

(51) Int. Cl.
*G03G 15/08* (2006.01)
*G03G 15/10* (2006.01)

(52) U.S. Cl. ..... 399/27; 399/30; 399/58

(58) Field of Classification Search ..... 399/27, 399/30, 58, 59, 60, 61, 62, 258, 259, 260
See application file for complete search history.

(56) References Cited

U.S. PATENT DOCUMENTS

| | | | | |
|---|---|---|---|---|
| 3,821,938 | A * | 7/1974 | Bacon et al. | 399/30 |
| 4,734,737 | A * | 3/1988 | Koichi | 399/58 |
| 5,678,131 | A * | 10/1997 | Alexandrovich et al. | 399/58 |
| 6,134,398 | A | 10/2000 | Grace | |
| 6,181,888 | B1 | 1/2001 | Scheuer et al. | |
| 6,223,006 | B1 | 4/2001 | Scheuer et al. | |
| 6,317,637 | B1 | 11/2001 | Limroth | |
| 6,349,183 | B1 * | 2/2002 | Nagamine et al. | 399/27 |
| 6,404,997 | B1 | 6/2002 | Grace | |
| 6,424,906 | B1 | 7/2002 | Zhu et al. | |
| 6,465,981 | B2 | 10/2002 | Zhang et al. | |
| 6,490,119 | B1 | 12/2002 | Mittal et al. | |
| 6,987,934 | B2 * | 1/2006 | Bessho et al. | 399/27 |
| 7,162,262 | B2 | 1/2007 | Jonsson et al. | |
| 7,433,613 | B2 * | 10/2008 | Zollner et al. | 399/30 |
| 7,532,830 | B2 | 5/2009 | Kumar et al. | |
| 2008/0131148 | A1 * | 6/2008 | Wong | 399/27 |
| 2009/0022506 | A1 * | 1/2009 | Aratake et al. | 399/27 |

FOREIGN PATENT DOCUMENTS

| | | | |
|---|---|---|---|
| JP | 06-161249 A | * | 11/1992 |
| JP | 2001-147580 A | * | 5/2001 |

* cited by examiner

*Primary Examiner* — Sandra Brase
(74) *Attorney, Agent, or Firm* — Gibb I.P. Law Firm, LLC

(57) ABSTRACT

A method and system includes updating an accumulated dispense value from within a toner dispense actuation loop and adjusting the accumulated dispense value by receiving dispense values from at least one control loop element that operates asynchronously from the toner dispense actuation loop. A temporary accumulated dispense value is stored when it is greater than or equal to a predetermined dispense saturation upper limit, or is less than or equal to a predetermined dispense saturation lower limit. An adjusted accumulated dispense value is calculated by subtracting the accumulated dispense value from the temporary accumulated dispense value and multiplying the difference by a predetermined optimized limit gain. A new accumulated dispense value is calculated by adding the adjusted accumulated dispense value to the accumulated dispense value. A toner dispense motor is activated for a time period equal to the on time value, and the on time value is subtracted from the new accumulator value.

19 Claims, 6 Drawing Sheets

OPTIMIZED LIMIT GAIN COMPENSATION FOR DISPENSE TIME ACCUMULATORS OF TONER CONCENTRATION CONTROL

BACKGROUND

The embodiments herein generally relate to printing devices and, more particularly, to an optimized limit gain component for a dispense time accumulator of a toner concentration control for dispensing toner in a developer housing of a printing engine.

In general, all printing engines have some form of "Toner Concentration (TC) Control" to maintain the desired amount of toner in a developer housing, which is usually achieved by means of dispensing toner into the developer housing by actuation of the dispense motor to maintain the desired image quality metrics. For cost savings, it is desirable to use DC motors instead of servo or stepper motors. To enable this, the concept of a dispense time accumulator/buffer is commonly used to enable decoupling of controls and actuation.

Use of this concept moves the dispense model away from simple classic continuous or discrete time-invariant systems, making it more complicated. However, one cannot directly apply the commonly used anti-windup architecture (which is directed toward the Integral (I) part of a Proportional-Integral (PI) control loop) that is applied only to synchronous, coupled systems. Therefore, the embodiments herein implement an equivalent anti-windup component in an accumulator/buffer that is decoupled and asynchronously operating from any control loop.

Since all actuators have physical limitations, a DC motor in a developer housing having a limited and finite velocity may have severe consequences for a PI (Proportional, Integral) controller, where integral action is an unstable mode. While this does not cause any difficulties when the loop is closed, a feedback loop will be broken when an actuator saturates (because the output of the saturating element is not influenced by its input). The unstable mode in the controller may then drift to very large values. When the actuator desaturates, it may take a long time for the system to recover, or it may also oscillate several times between high and low before the system recovers.

Integrator windup occurs due to the saturation in the actuator where the control signal saturates immediately when the step is applied. The control signal then remains in saturation level and the feedback is broken and the integral part continues to increase because the error is positive. The integral part starts to decrease when the process output has become larger than the setpoint, but the process output remains saturated because of the large integral part. Slowly, the process output decreases towards the setpoint. The net effect of this process is a large overshoot called, "integrator windup."

The controller operates linearly only if the process output is in the range of the minimum and maximum output, and the controller output saturates when the process output is outside this range. A controller models in parallel form with the anti-windup scheme having extra proportional band variables equal to the minimum and maximum output based on the integral part. Thus, integrator windup can be avoided by making sure that the integral is kept to a proper value when the actuator saturates so that the controller is ready to resume action, as soon as the control error changes.

SUMMARY

However, anti-windup architectures have been only applied to synchronous, coupled systems and not to asynchronous, decoupled systems such as a Toner Concentration Control loop having an accumulator/buffer. The embodiments herein provide a way of achieving an equivalent anti-windup component as an optimized limit gain in systems that use a decoupled, asynchronous dispense time accumulator/buffer.

In accordance with one embodiment, a computer-implemented method receives dispense values from at least one control loop element regarding an amount of marking material needed to be dispensed for a printing engine and accumulates the dispense values within a computer readable storage medium as an accumulated dispense value. The accumulated dispense value is compared with a predetermined upper limit dispense value and a predetermined lower limit dispense value. A temporary value is set equal to the predetermined upper limit, when the accumulated dispense value is greater than or equal to the predetermined upper limit dispense value. Alternatively, the temporary value is set equal to the predetermined lower limit, when the accumulated dispense value is less than or equal to the predetermined lower limit dispense value.

The accumulated dispense value is subtracted from the temporary value to obtain an intermediate value. The intermediate value is then multiplied by an optimized limit gain to produce an updated dispense value. The updated dispense value is added to the accumulated dispense value to produce an updated accumulated dispense value which is compared with a time limit. A toner dispense motor is activated for the time limit and the time limit is subtracted from the accumulated dispense value, when the updated accumulated dispense value exceeds the time limit.

In accordance with another embodiment, a computer-implement method updates accumulated dispense value from within a toner dispense actuation loop, and adjusts the accumulated dispense value by receiving dispense values from at least one control loop element that operates asynchronously from the toner dispense actuation loop. A temporary accumulated dispense value is stored when the accumulated dispense value is greater than or equal to a predetermined dispense saturation upper limit, or when the accumulated dispense value is less than or equal to a predetermined dispense saturation lower limit. An adjusted accumulated dispense value is calculated by subtracting the accumulated dispense value from the temporary accumulated dispense value, and multiplying the difference by a predetermined optimized limit gain. A new accumulated dispense value is calculated by adding the adjusted accumulated dispense value to the accumulated dispense value. A toner dispense motor is activated for a time period equal to the on time value, and the on time value is subtracted from the new accumulator value based on determining when the new accumulation variable is greater than or equal to the on time value.

In accordance with an additional embodiment, a printing engine system includes a toner concentration (TC) controller that has a dispense time accumulator buffer and at least one control loop that transmits a dispense value to increment or decrement the dispense time accumulator buffer. A toner dispense actuation loop controls a toner dispense motor based on updating the value of the dispense time accumulator buffer. The developer housing includes the toner dispense motor, toner, a developer and a toner concentration (TC) sensor for the printing engine.

With these features, the embodiments herein provide an equivalent anti-windup component as an optimized limit gain in systems that use a decoupled, asynchronous dispense time accumulator/buffer.

BRIEF DESCRIPTION OF THE DRAWINGS

The foregoing and other exemplary purposes, aspects and advantages will be better understood from the following detailed description of an exemplary embodiment with reference to the drawings, in which.

DETAILED DESCRIPTION

Figure 1:
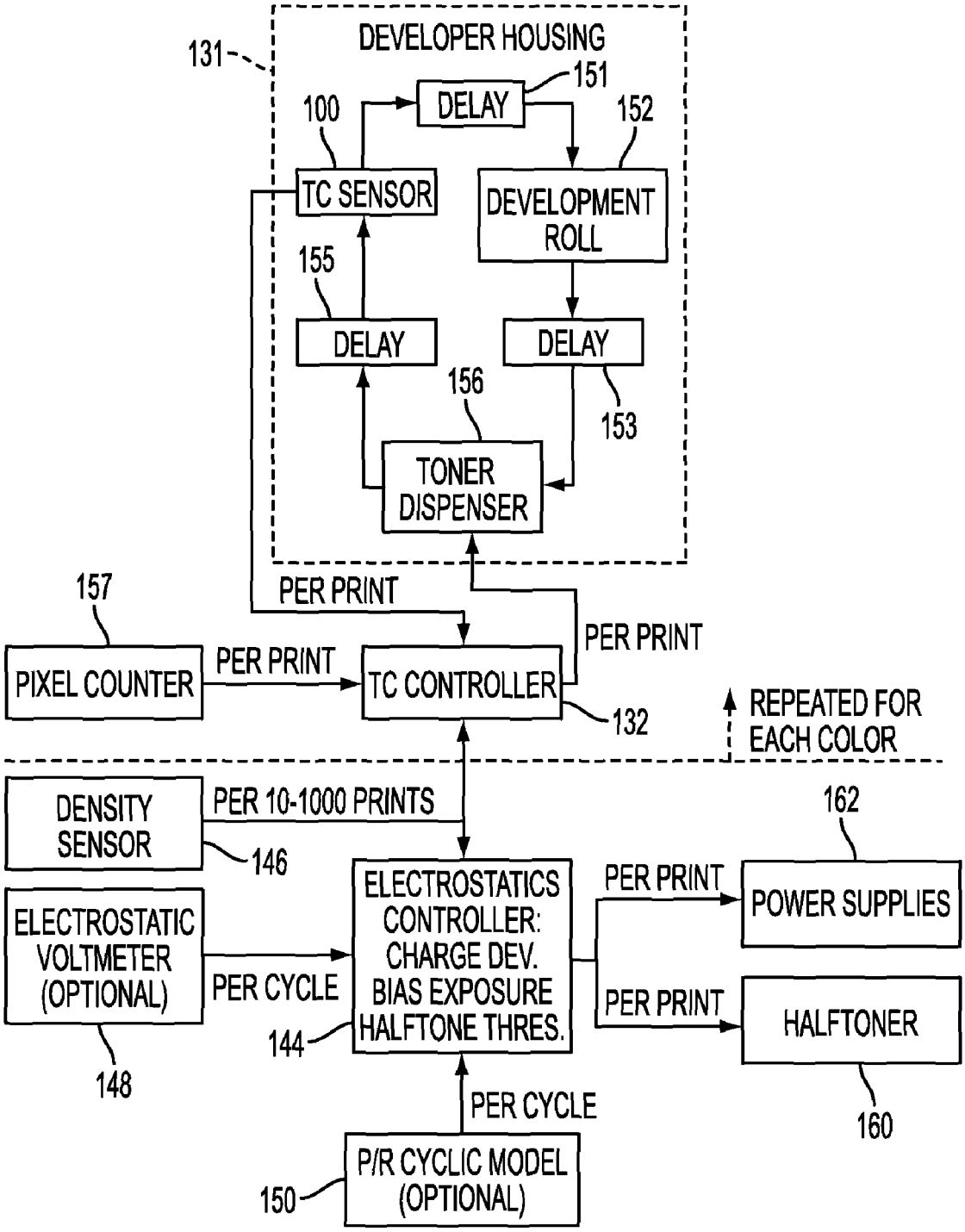
FIG. 1 is a schematic diagram that illustrates a control method and apparatus according to embodiments herein.

FIG. 1 is a block diagram illustrating toner concentration modeling that may be implemented for each developer housing 44, 54, 56, or 58 of the imaging machine of FIG. 6 discussed below in order to carry out embodiments herein. FIG. 1 represents actual response times and propagation delays due to toner mixing and transport within the development housing 131, as well as delays between density sensing and toner dispensing to generate appropriate control signals for toner concentration controller 132. These are generally fixed values, but may be adjusted periodically or otherwise to account for machine aging. In addition, time delays and behavioral values of the various elements of the developer housing module 131 are characteristic of, and unique to each different type of imaging machine.

Figure 6:
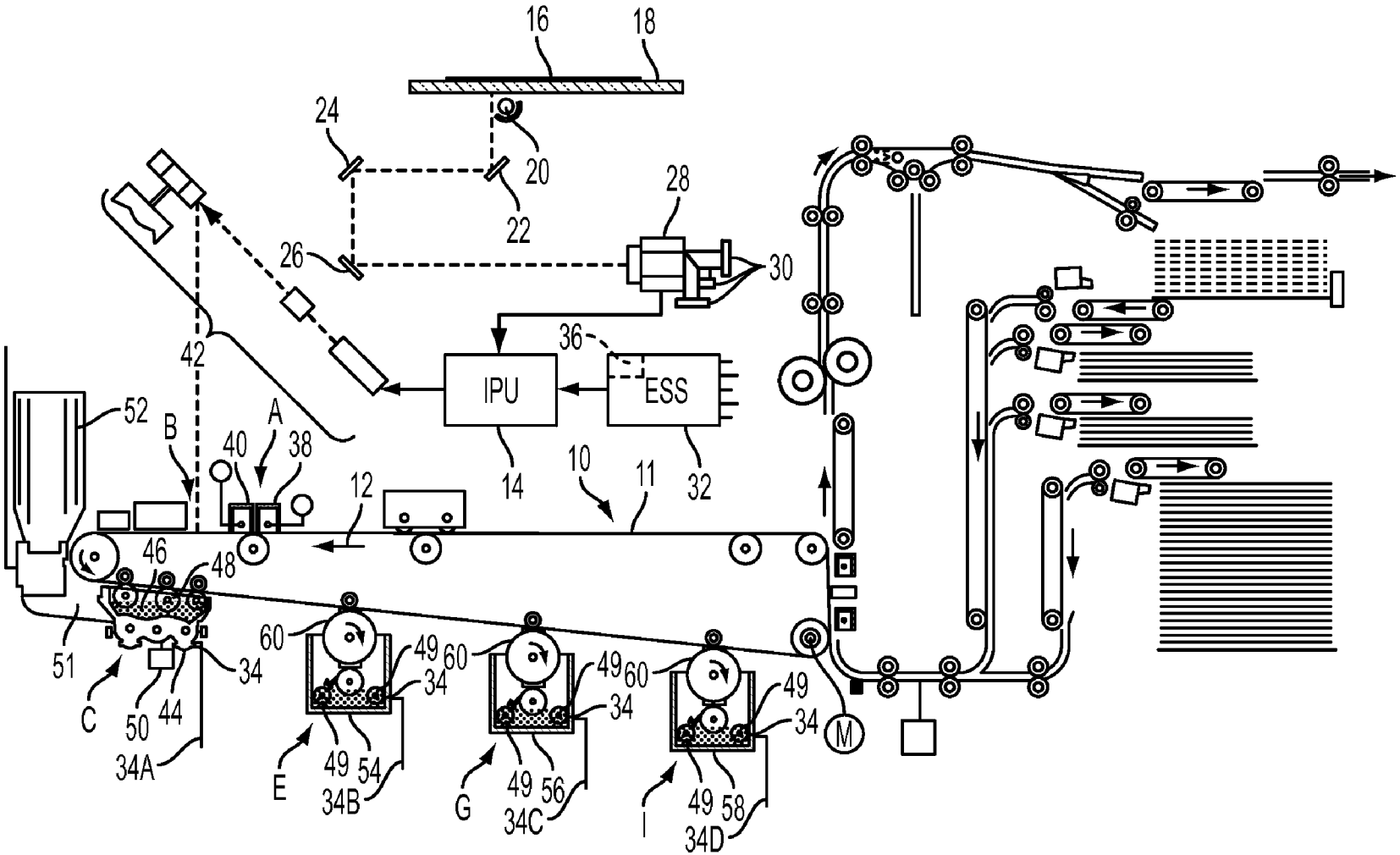
FIG. 6 is a schematic diagram that illustrates a multipass color electrophotographic imaging machine in which embodiments herein may be deployed.

A toner concentration controller 132, which may be implemented by ESS 32 (shown in FIG. 6), responds to signals from module 131 to control replenishment of toner from, for example, toner supply 51 of FIG. 6. A controller 132 also responds in a conventional manner to print-by-print pixel counter information to replenish toner based on coverage area of original document 16 and to image density sensor 146 that supplies a feedback signal to electrostatic controller 144 every ten to one thousand print cycles. The optional electrostatic voltmeter 148 can cyclically supply a feedback signal to electrostatic controller 144 to maintain electrostatic set points within predetermined ranges. Optionally, a photoreceptor cyclic module 150 may be provided to model the behavior of photoreceptor 10 to compensate for start-up transient conditions. Power supplies 162 and halftone module 160 receive outputs from the electrostatic controller for adjustment on a per print basis.

Parameters of development housing module 131 represent actual developer housing dynamics of the imaging machine. Toner concentration sensor 100 indicates the actual concentration of toner in the developer mixture 46 of FIG. 6 at a specific point in the flow path of the development unit, while development roll 152 is equivalent to development roll 48 of FIG. 6, for example. Time delays 151, 153, and 155 are based on the type and characteristics of the particular imaging machine. Such delays, among other things, reflect the time period for transport of developer material between and among the developer reservoir, transport rolls, developer rolls at the development stations during development of the latent image, or other behavioral characteristics of the developer housing or the imaging machine that impact toner density.

A density sensor 146 senses actual print density of the developed latent image at a sample interval of, for example, ten to one thousand prints, in order to compensate for long-term drift. The density signal is applied to the toner concentration (TC) controller 132 and the electrostatics controller 144. The acquisition of density data, usually obtained from a test patch on or near the developed latent image, requires a very high bandwidth in a data path between the density sensor and the ESS 32, which processes the density data in order to generate and transmit the appropriate toner concentration adjustment or correction signals. Electrostatic voltages of the electrostatic development fields may be measured using an electrostatic voltmeter 148, the resulting measurement being transmitted from the voltmeter 148 to the electrostatic controller 144.

A model of short-term photoreceptor (P/R) cyclic behavior 150 may be incorporated into the electrostatics controller 144 to enable correction for start-of-run transients. Pixel counter 157 provides the primary print-by-print information with which toner dispense is regulated by toner concentration controller 132.

Toner concentration controller 132 also receives signals from the actual toner concentration (TC) sensor 100, which corresponds to sensed toner concentrations at the toner concentration sensor. The control circuit responds to control signals from controller 132 to regulate the amount and rate at which toner is dispensed from the container.

Printing engines have various forms of controls architectures, as described above, to track and maintain their image quality performance and stability. Toner concentration (TC) control maintains image quality by means of dispensing toner into the developer housing through actuation of the dispense motor. For cost savings, there is an increasing trend towards using DC motors, (see DC toner dispenser motor 156 of FIG. 1), instead of servo or stepper motors for dispensing toner, which requires the use of the concept of dispense time accumulator/buffer for decoupling controls and actuation. Though powerful and efficient, using the accumulator/buffer methodology moves the TC dispense model away from simple classic continuous or discrete time-invariant systems to a more complicated non-continuous/asynchronous, time independent systems.

In view of this, embodiments herein provides a way of achieving an optimized limit gain component useful with less expensive DC motors that is equivalent to an anti-windup component in continuous or discrete time-invariant systems that use the concept of a dispense time accumulator/buffer. This optimized limit gain component achieves a reduction in Toner Concentration Variations caused due to extreme area coverage changes resulting in better TC stability and thus better image quality stability.

Thus, the embodiments herein allow the utilization of less expensive DC actuators in decoupled, asynchronous systems, but still provide the accuracy enjoyed by architectures that utilize anti-wind up feedback loops of close-coupled, synchronous systems. More specifically, with systems that use inexpensive DC motors (and buffers/accumulators to control the DC motor based toner dispensing) the embodiments herein provide an anti-windup mechanism by determining when a buffer is requesting a toner dispenser to output more than it has the ability to produce (more than 100% of its time based production capability). The embodiments herein detect such a situation and reduce the amount that is being requested from the toner dispenser (to avoid windup) by finding how much excess is being requested from the toner dispenser above its abilities. This excess amount is then multiplied by a gain value (using a feedback loop) and the result of this multiplication is subtracted from the buffer (subtracted from the amount being demanded of the toner dispenser). This reduces the demands being made upon the toner dispenser to ones that are within its capabilities, and thereby avoids windup. Further, by altering the amount within the buffer in the anti-windup mechanism, the embodiments herein can be applied to decoupled, asynchronous systems that use inexpensive DC motors (and buffer/accumulators to control such DC motors).

Figure 2:
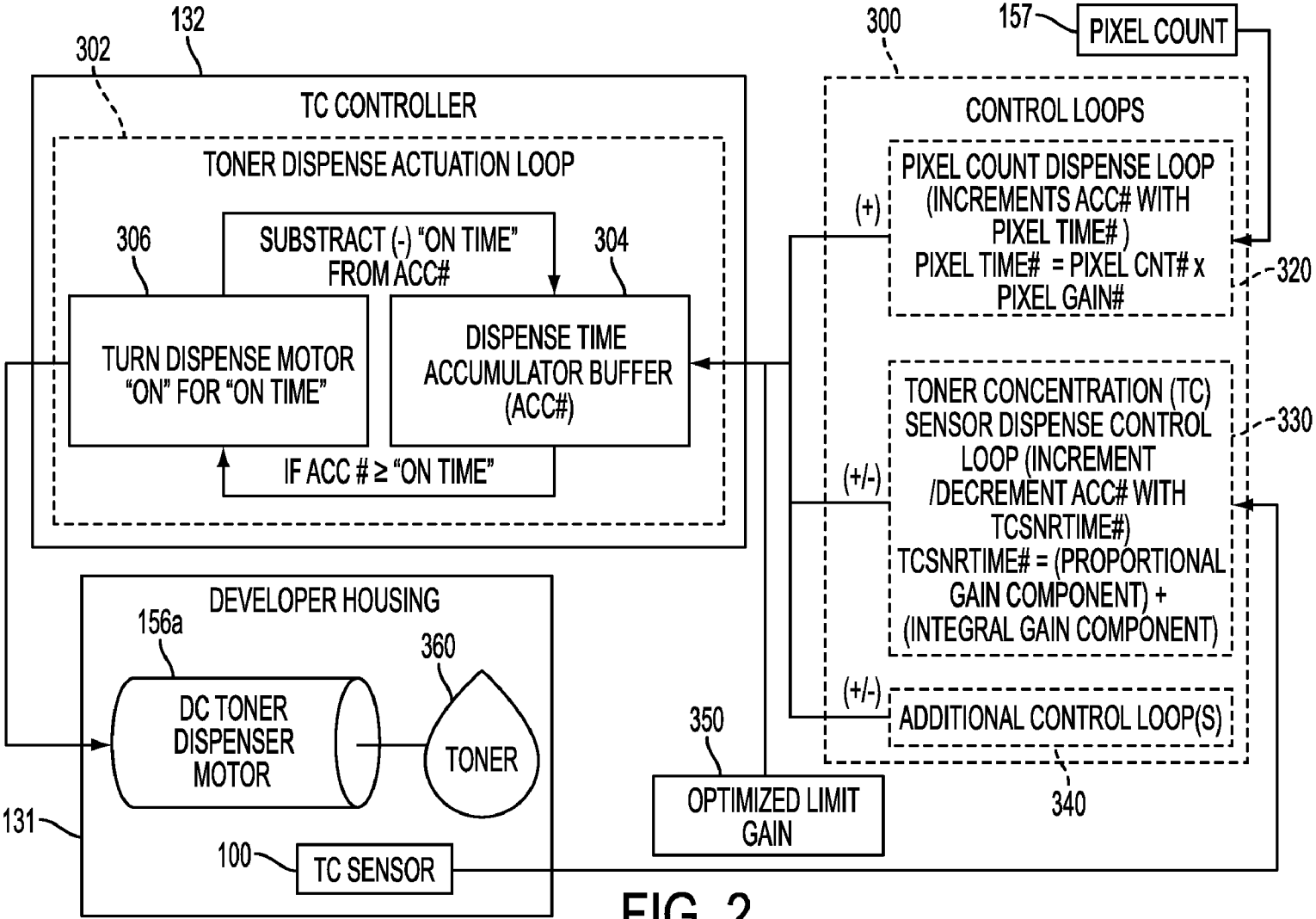
FIG. 2 is a schematic diagram that illustrates a block diagram illustrating a control method and apparatus of the Toner Concentration (TC) Controller of FIG. 1 according to embodiments herein.

This is shown more specifically in FIG. 2, which is a block diagram illustrating a control method and apparatus that includes the Toner Concentration (TC) Controller 132, developer housing 131 and pixel counter 157 of FIG. 1. Control loops 300 may include a pixel counter dispense loop 320 that receives a feedback signal from pixel counter 157 of FIG. 1, a toner Concentration (TC) sensor dispense control loop 330 that receives a feedback signal from TC sensor 100 in the developer housing 131 of FIG. 1, or any other additional control loops 340. These control loops transmit either an incrementing (+) or a decrementing (−) dispense value to a dispense time accumulator buffer 304 located in a toner dispense actuation loop 302 in the TC controller 132 of FIG. 1.

Additionally, an optimized limit gain is independently calculated for each machine or each developer housing in a machine, and is transmitted to the toner dispense actuation loop to limit the value of the dispense time accumulator buffer 304 when an upper or lower saturation dispense limit is reached. A determination is made when the dispense time accumulation buffer is greater than or equal to an "ON TIME" value, and a signal that turns on or activates a dispense motor 156*a* is generated in block 306 for controlling the DC toner dispenser motor 156*a* to dispense toner 360 in the developer housing 131. Once the dispense motor is activated 306, the "ON TIME" value is subtracted from the current dispense time accumulator buffer, thus updating the dispense time accumulator buffer at a first frequency.

Each of the dispense control loops of the control loops 300 operates at a frequency different than that of the dispense time accumulator buffer 304. For example, the pixel counter dispense loop 320 increments the accumulator buffer 304 with a pixel time# equivalent to the product of a pixel counter and a pixel gain for a time period equal to every image panel that is processed by the machine.

In another example, the toner Concentration (TC) sensor dispense control loop takes a feedback signal from the TC sensor 100 in the developer housing 131 to generate a TC sensor time value (TCSNRTIME#) that either increments or decrements the accumulator buffer 304 with the sum of a proportional (P) gain component of an error signal and an integral (I) gain component of the error signal. The proportional (P) term (sometimes called gain) makes a change to the output that is proportional to the current error value. The proportional response can be adjusted by multiplying the error by a constant Kp (not shown), called the proportional gain. The contribution from the integral (I) term (sometimes called reset) is proportional to both the magnitude of the error and the duration of the error.

Summing the instantaneous error over time (integrating the error) gives the accumulated offset that should have been corrected previously. The accumulated error is then multiplied by the integral gain and added to the controller output. The magnitude of the contribution of the integral term to the overall control action is determined by the integral gain, Ki (not shown). The frequency of the transmitted dispense values from the TC control loop can be specified as independent periods of "X" time (seconds).

The additional control loop(s) 340 may also operate independently of the frequency of operation of the toner dispense actuation loop 302. This independent operation of the control loops 300 is therefore decoupled from the toner dispense actuation loop 302 in the TC controller 132 and thus necessitates an alternative approach to calculating a component that may operate as an "anti-windup" component in a synchronous, coupled system between a control loop(s) and a toner dispense actuation loop.

Figure 3:
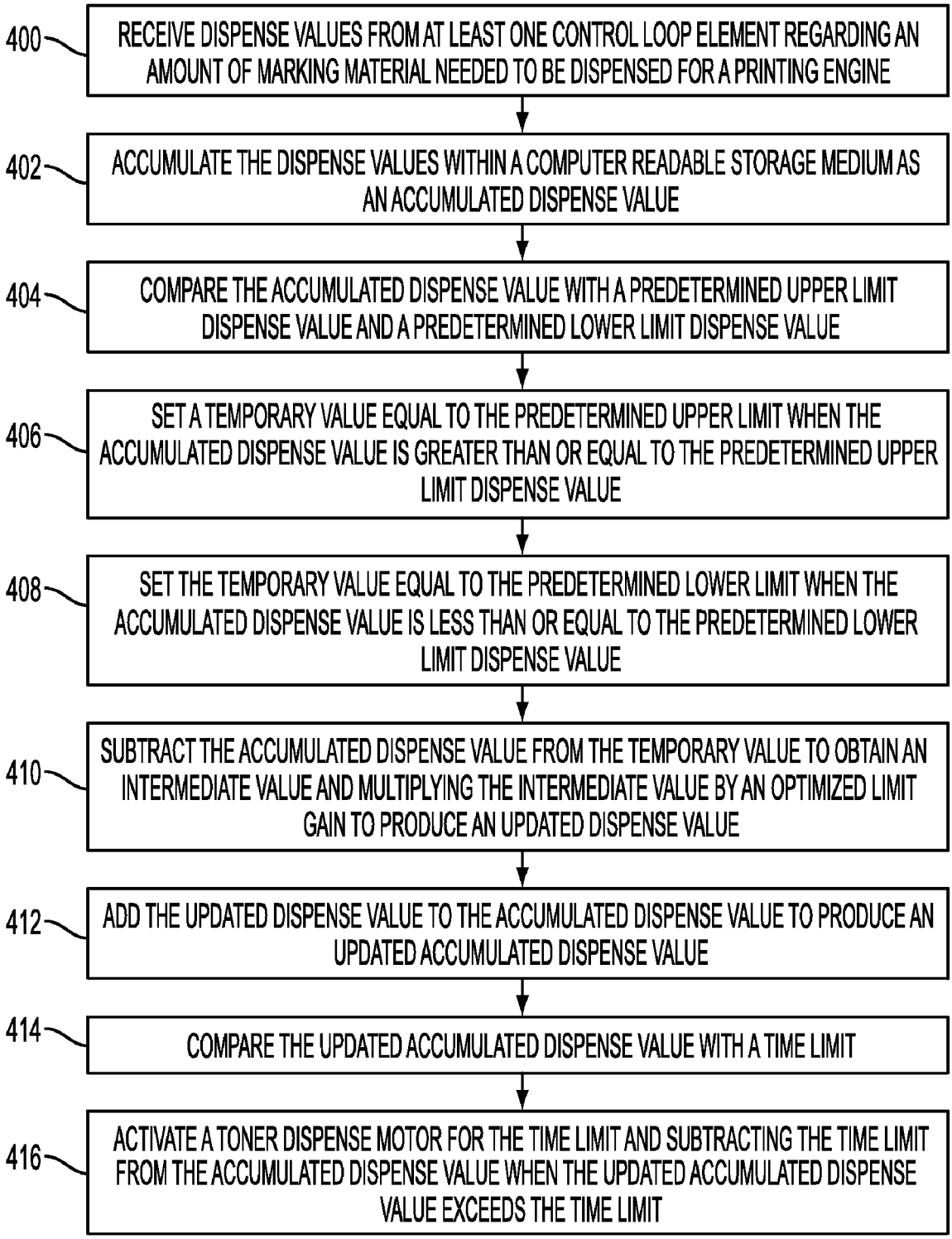
FIG. 3 is an exemplary flowchart setting forth steps according to embodiments herein.

FIG. 3 is an exemplary flowchart setting forth steps according to a computer-implemented method that receives dispense values from at least one control loop element regarding an amount of marking material needed to be dispensed for a printing engine 400, and accumulates the dispense values within a computer readable storage medium as an accumulated dispense value 402. The accumulated dispense value is compared with a predetermined upper limit dispense value and a predetermined lower limit dispense value 404. A temporary value is set equal to the predetermined upper limit, when the accumulated dispense value is greater than or equal to the predetermined upper limit dispense value 406. Alternatively, the temporary value set equal to the predetermined lower limit, when the accumulated dispense value is less than or equal to the predetermined lower limit dispense value 408.

The accumulated dispense value is then subtracted from the temporary value to obtain an intermediate value. The intermediate value is multiplied by an optimized limit gain to produce an updated dispense value 410. The updated dispense value is added to the accumulated dispense value to produce an updated accumulated dispense value 412, which is compared with a time limit 414. A toner dispense motor is activated for the time limit and the time limit is subtracted from the accumulated dispense value, when the updated accumulated dispense value exceeds the time limit 416.

The control loop element may include a pixel counter dispense loop 320 from FIG. 2 or a toner concentration (TC) sensor dispense control loop 330. The optimized limit gain 350 includes a user defined and optimized value for a specific developer housing. The toner dispense motor may be a DC motor 156*a* operating under control of the updated accumulated dispense value (ACC#, 304). The computer readable storage medium, or buffer 304, is decoupled from and operating asynchronously from the control loop element(s) at 300.

Figure 4:
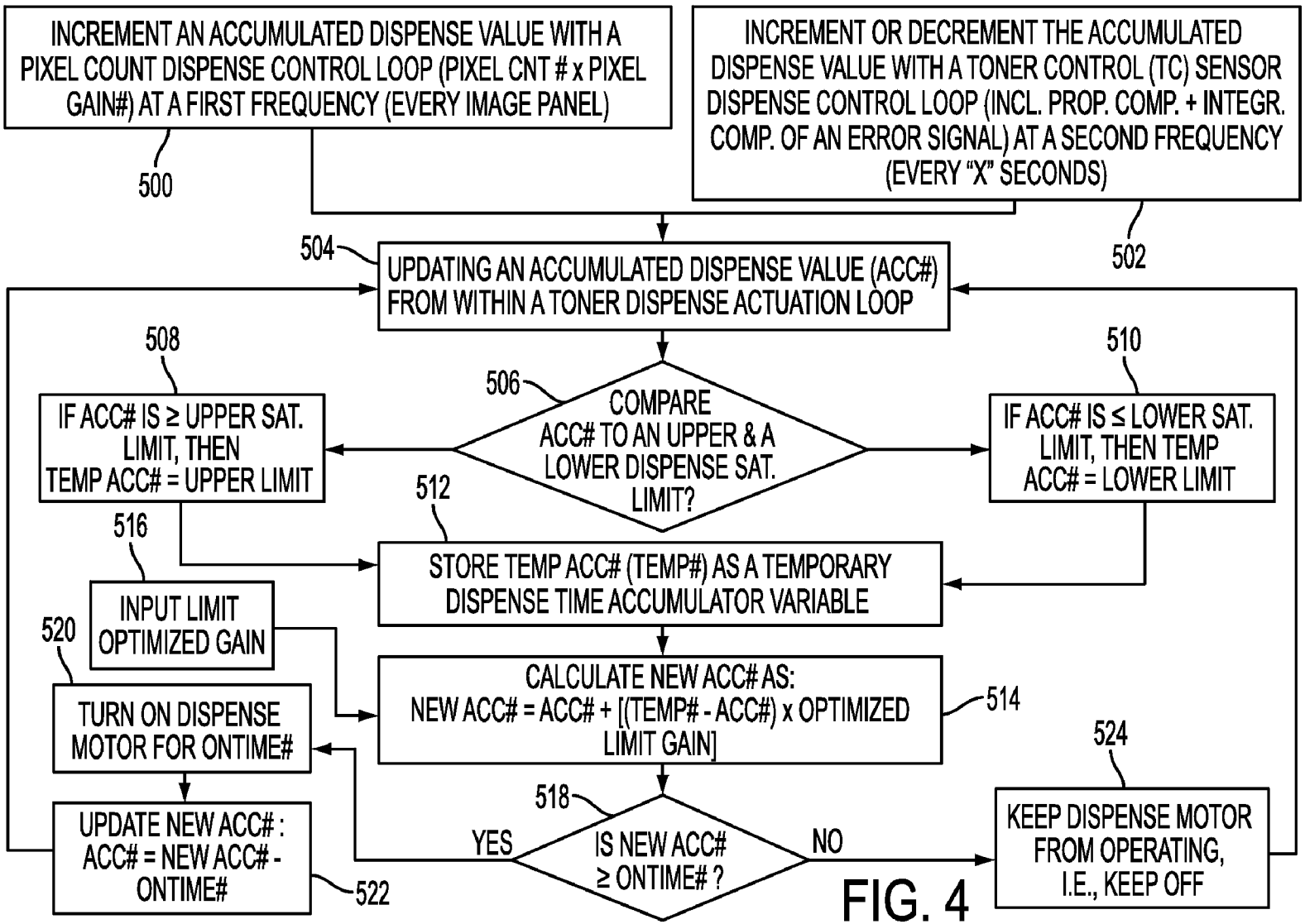
FIG. 4 is an exemplary flowchart setting forth steps according to another embodiment herein.

FIG. 4 is an exemplary flowchart setting forth steps according to another computer-implement method that updates an accumulated dispense value from within a toner dispense actuation loop 504 and adjusts the accumulated dispense value by receiving dispense values from control loop elements 500, 502 that operate asynchronously from the toner dispense actuation loop 302.

Based on a comparison of the accumulated dispense value to an upper and a lower dispense saturation limit 506. A temporary accumulated dispense value is stored 512 when the accumulated dispense value is greater than or equal to a predetermined dispense saturation upper limit 508, or when the accumulated dispense value is less than or equal to a predetermined dispense saturation lower limit 510. An adjusted accumulated dispense value, (see 514), is calculated by subtracting the accumulated dispense value from the temporary accumulated dispense value and multiplying the difference by a predetermined optimized limit gain 350 of FIG. 2, which is input 516 into the toner dispense actuation loop 302 of FIG. 2.

A new accumulated dispense value is calculated by adding the adjusted accumulated dispense value to the accumulated dispense value 514. A toner dispense motor is activated for a time period equal to the "ON TIME" value 520 after determining the new accumulated dispense value is greater than or equal to an "ON TIME" value 518. The "ON TIME" value is then subtracted from the new accumulator value based on determining when the new accumulation variable is greater than or equal to the "ON TIME" value 522. Otherwise, the dispenser motor is kept from operating 524 and the accumulated dispense value is continuously updated at a first frequency per the controls of the developer housing 131 of FIG. 2.

The toner dispense motor includes a DC motor (156*a* of FIG. 3) located within a developer housing 131 of a printing engine. The control loop may include a pixel counter dispense control loop 320 that transmits dispense values to update the accumulated dispense value 304 at a second frequency equivalent to processing each received image panel. The pixel counter dispense control loop 320 of FIG. 2 transmits the dispense values equivalent to a pixel time value equal to a product of a pixel counter value and a pixel gain value.

The control loop may include a toner control sensor dispense control loop 330 of FIG. 2 that transmits dispense values to update the accumulated dispense value at a third frequency equivalent to a predetermined period of time. The toner control sensor dispense control loop 330 of FIG. 2 transmits the dispense values equivalent to a toner control sensor time value equal to the sum of a proportional gain component of an error signal and an integral gain component of the error signal.

In accordance with an additional embodiment, a printing engine that includes a toner concentration (TC) controller 132 of FIG. 2 that has a dispense time accumulator buffer 304 and at least one control loop 300 that transmits a dispense value to increment or decrement the dispense time accumulator buffer 304. A toner dispense actuation loop 302 of FIG. 2 controls the DC toner dispense motor 156*a* based on updating the value of the dispense time accumulator buffer 304, and a developer housing 131 includes the toner dispense motor 156*a*, toner 360, a developer (i.e., C, E, G and I of FIG. 6) and a toner concentration (TC) sensor 100 for the printing engine.

The control loop 300 may include a toner concentration (TC) sensor dispense control loop 330 that generates the dispense value based on the toner concentration (TC) sensor 100 in the developer housing 131 by summing a proportional gain component of an error signal with an integral gain component of the error signal.

Additionally, or in the alternative, the control loop may include a pixel counter dispense loop 320 that generates the dispense value based on a pixel counter element equal to a product of a pixel counter value with a pixel gain value.

The toner dispense actuation loop 302 updates the value of the dispense time accumulator buffer at a first frequency (different from at least one second frequency) of the control loop 300 transmitting the dispense value to increment or decrement the dispense time accumulator buffer 304.

The toner concentration (TC) controller 132 calculates an adjusted dispense time accumulator buffer value by determining the difference between the dispense time accumulator buffer value and the upper or lower saturation limit. Next, the difference between the buffer value and the limits is multiplied by a predetermined optimized limit gain value. The product of such multiplication is added to the dispense time accumulator buffer value to produce a "sum value" that is added to the buffer. Thereafter, the toner dispense actuation loop actuates the toner dispense motor when the adjusted dispense time accumulator buffer value is greater than or equal to a predetermined toner dispense motor "on time" value.

The embodiments herein detect when a saturation condition is occurring by measuring the excess operation that is requested from actuator relative to the maximum that can be produced by the actuator. Therefore, if actuator can only produce 100 units in a given time period, but is being requested to output 120 units in that same time period, the saturation amount would be the 20 units or 20%.

The embodiments herein generate a temporary value (which corresponds to the upper limit of the actuators capability). Therefore, in the foregoing example, the upper limit could be defined as 100 units per given time period, and this would be the temporary value. The actual accumulator value demanded (which in the foregoing example would be 120 units) is subtracted from the temporary value and multiplied by an optimized limit gain value determined independently for each actuation. For example, a 2× gain could be multiplied by the difference between the temporary number (100) and the accumulator number (120), resulting in a −40. This −40 is added to the accumulator number (120) resulting in an updated accumulator number of 80. Then, the updated accumulated number is compared to the time limit to determine whether to turn the actuator on for the predetermined time. With these novel features, the embodiments herein may provide an equivalent anti-windup component as an optimized limit gain in systems that use a decoupled, asynchronous dispense time accumulator/buffer.

Figure 5A:
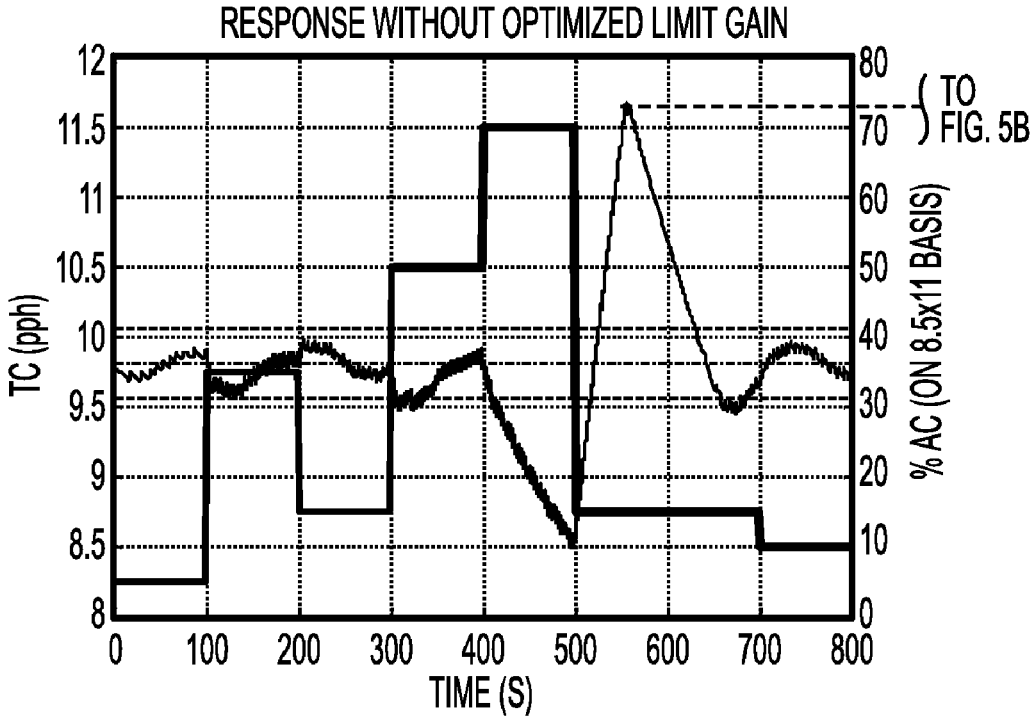
FIG. 5A is a graph of a Toner Concentration (TC) output versus time without an optimized limit gain component.

FIG. 5A illustrates a graph of a Toner Concentration (TC) output versus time without an optimized limit gain component. At 500 seconds, the TC spikes to over 11.5 pph. Note the % Area Coverage (AC) is the bold line and indexed on the right vertical axes of both graphs.

Figure 5B:
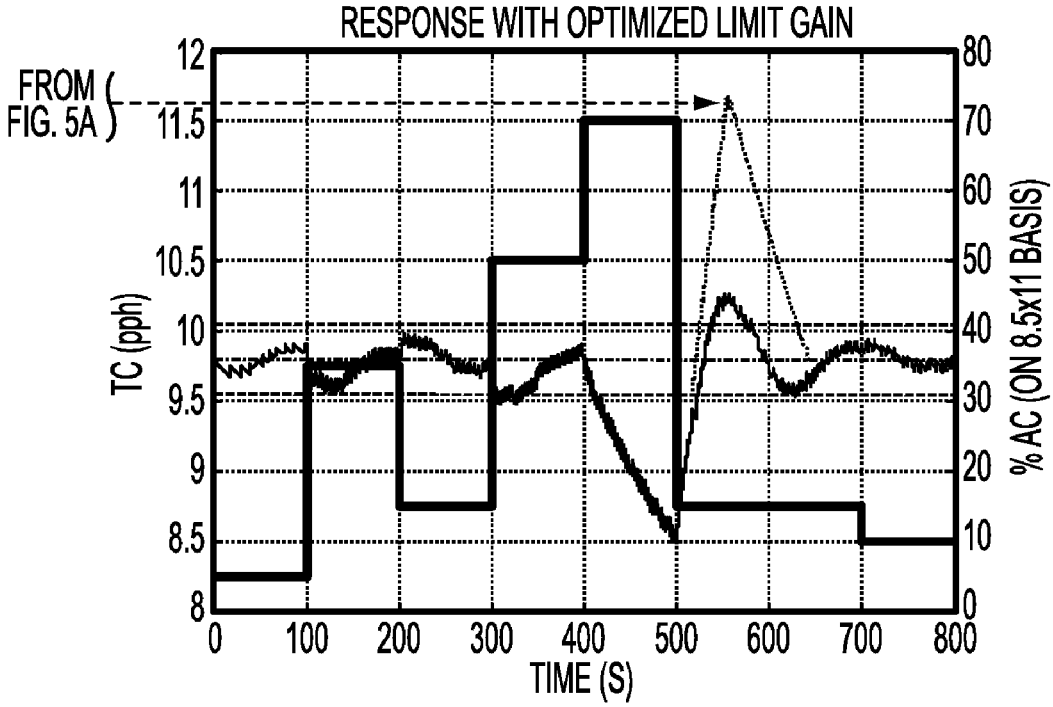
FIG. 5B is a graph of a Toner Concentration (TC) output versus time with an optimized limit gain component of one embodiment provided herein.

FIG. 5B illustrates a graph of a Toner Concentration (TC) output versus time with an optimized limit gain component of one embodiment included herein. At 500 seconds the TC only rises to around 10.25. Note the dotted spike curve of FIG. 5A superimposed on FIG. 5B for comparison purposes to illustrate the difference in magnitude between a system with the optimized limit gain and a system without the optimized limit gain.

FIG. 6 shows an exemplary multipass color electrostatographic reproduction or imaging machine that may utilize various embodiments herein. The imaging machine, which is more particularly described in incorporated U.S. Pat. Nos. 6,134,398 and 6,404,997 assigned to the same assignee hereof, includes a photoreceptor belt 10 having a photoconductive surface 11 that carries an electrostatic latent image formed thereon to various image processing stations along the path of belt 10 in the direction 12. Controlled amounts of toner are applied to each latent image as it passes development stations C, E, G, and I in a multipass operation. The amount of toner applied is dictated, among other things, by toner concentration and electrostatic potentials at the development unit. To control the amount of toner applied to the latent image, electrostatic potentials and other electrical set points may be controlled almost instantaneously whereas toner concentration at the development roll is subject to mixing and transport delays.

As known in the art, color reproductions may be derived from a computer generated image that is electronically conveyed to an image processor 14 or from an original document 16 placed on the surface of a transparent platen 18. In the latter case, a scanning assembly including a light source 20 illuminates the document 16 whereupon light reflected from document 16 is reflected by mirrors 22, 24, and 26 through a series of lenses (not shown) and a dichroic prism 28 to three color separating, charged-coupled linear photosensing devices (CCDs) 30 where the information is read. Each CCD 30 outputs a digital image signal that is proportional to the intensity of the incident light of a respective color separated region of original document 16. The digital signals represent each pixel and are indicative of blue, green, and red densities. They are conveyed to the IPU 14 where they are converted into color separations and bit maps, typically representing yellow, cyan, magenta, and black.

As previously indicated, the image coverage area of original document 16 may vary from print-to-print, and this may have a deleterious impact on image density of the reproduced image should toner concentration fluctuate outside of a pre-established range. Color separation and bit map information may be used to control the delivery of toner at development stations C, E, G, and I in order to achieve a desired toner density in the developed latent image, but very often, this is marginally effective to compensate for variations of toner density in the latent image during print-to-print fluctuations in toner concentration. Although illustrated separately, the housing of development stations C, E, G, and I are often combined for compactness in a single unit having respective compartments for the individual toners. As previously indicated, this makes the system more susceptible to toner concentration fluctuations.

The imaging machine of FIG. 6 includes an electronic subsystem (ESS) 32 that comprises a central processor unit (CPU), memory, and a display or user interface (UI). ESS 32 with the help of toner concentration sensors at connections 34, 34*a*, 34*b*, 34*c*, and 34*d*, as well as an optional pixel counter 36, reads, captures, prepares and/or manages toner concentration, electrostatic set points, and other machine functions. In addition, ESS 32 performs multi-tasking operations such as imaging, development, sheet delivery and transfer, and the operating or "on" time control mode and/or algorithm for each of the development units.

Initially, in a first imaging pass, photoreceptor 10 passes charging station A where corona generating devices 38 and 40 charge photoreceptor 10 to a relatively high, substantially uniform potential. Next, in this first imaging pass, the charged portion of photoreceptor 10 advances through an imaging station B. At imaging station B, the uniformly charged belt 10 is exposed to the scanning device 42, which forms a latent image on surface 11 of belt 10 by discharging certain regions thereof, e.g., text or graphic patterns, in accordance with one of the obtained color separations and bit map outputs, e.g., black, of the scanning device 42. Scanning device 42 is a laser Raster Output Scanner (ROS) that creates color separation images as a series of parallel scan lines having a certain resolution, generally referred to as lines per inch.

At a first development station C, a non-interactive two-component development unit 44, advances developer material 46 containing, for example, charged toner particles and carrier particles in the form of ferromagnetic beads of a desired and controlled ratio into contact with a donor roll 48, and donor roll 48 then advances charged toner particles admixed with developer material 46 into contact with the latent image and any latent target marks on surface 11. The sump or reservoir of developer housing 44 includes mixing augers (items 49 at stations E, G, I) that mix toner and carrier particles. Transport of developer material 46 from the sump of the developer housing 44 to the latent image on the surface 11 generally takes a few seconds. Development stations E, G, and I, which include donor rolls 60 and dispense remains unchanged in block 208. If so, then the long term drift is computed based on the results of the comparison between projected and actual toner concentration in block 210, and the dispense rate is modified according. In either case, setpoints stored in electrostatic controller 144 are appropriately adjusted and the development process is initiated in block 212. The process described in FIG. 2 is repeated for each print.

Development unit 44 may also include a plurality of magnetic brush and donor roller members, plus rotating augers or other means for mixing toner and carrier particles, all of which contribute to the delay of applying toner of a desired concentration to the latent image. A special feature of non-interactive development is that adding and admixing of toners can continue even when development is disabled. Therefore the timing algorithm for the adding and admixing function can be independent of that for the development function, as long as admixing is enabled whenever development is required. These donor roller members transport charged toner particles to the latent image for development thereof which tones the particular color separation image areas and leaves other areas untoned. Power supply 50 electrically biases development unit 44. Other development stations 54, 56, and 58 have similar biasing. In accordance with embodiment herein, timing algorithms for admixing and transport may be altered in advance of toner needs based on anticipated delays in transport and mixing.

Development or application of the charged toner particles to the latent image depletes the level and hence the concentration of toner particles in developer material 46. Different jobs of several documents being reproduced will cause toner depletion at different rates depending on the sustained, copy sheet area toner coverage, or toner area coverage level of the images thereof being reproduced. In a machine using a two-component developer material, as here, such depletion undesirably changes the concentration of such particles in the developer material. Momentary depletion is exacerbated when the developer mass is relatively small. In order to maintain the desired concentration of toner particles in the developer material 46 (in an attempt to insure the continued quality of subsequent images), adding and admixing functions of the development unit 44 must be operating or turned "on" for some controlled period of time in order for the hopper 50 to replenish the development unit 44 with fresh toner particles from source 52. Such fresh toner particles must then be admixed with the carrier particles in order to properly charge them triboeletrically.

On a second and subsequent passes of an image region on belt 10 of the multipass imaging machine, corona devices 38 and 40 recharge and adjust the voltage level of both the toned (from the previous imaging pass), and untoned areas on photoreceptor 10 to a substantially uniform level. This prepares the surface 11 to receive additional latent images on which toner particles of other colors are deposited by development stations E, G, and I. Recharging devices 38 and 40 substantially eliminate any voltage difference between toned areas and bare untoned areas, as well as to reduce the level of residual charge remaining on the previously toned areas so that subsequent development of a latent image of a different color separation is formed across a uniform development field. Imaging device 42 is then used on the second and subsequent passes of the multipass imaging machine to superimpose a subsequent latent image of a particular color separation image by selectively discharging the recharged photoreceptor 10.

Many computerized devices are discussed above. Computerized devices that include chip-based central processing units (CPU's), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted here from to allow the reader to focus on the salient aspects of the embodiments described herein. Similarly, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known by those ordinarily skilled in the art and are discussed in, for example, U.S. Pat. No. 6,032,004, the complete disclosure of which is fully incorporated herein by reference. The embodiments herein can encompass embodiments that print in color, monochrome, or handle color or monochrome image data. All foregoing embodiments are specifically applicable to electrostatic and/or xerographic machines and/or processes.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the embodiments herein cannot be implied or imported from any above example as limitations to any particular order, number, position, size, shape, angle, color, or material.

What is claimed is:

1. A computer-implemented method comprising:

receiving, by a processor, dispense values from at least one control loop element regarding an amount of marking material needed to be dispensed for a printing engine;

accumulating said dispense values within a computer readable storage medium as an accumulated dispense value, using said processor;

comparing said accumulated dispense value with a predetermined upper limit dispense value and a predetermined lower limit dispense value, using said processor;

setting a temporary value equal to said predetermined upper limit, using said processor, when said accumulated dispense value is greater than or equal to said predetermined upper limit dispense value;

setting said temporary value equal to said predetermined lower limit, using said processor, when said accumulated dispense value is less than or equal to said predetermined lower limit dispense value;

subtracting said accumulated dispense value from said temporary value to obtain an intermediate value and multiplying said intermediate value by an optimized limit gain to produce an updated dispense value, using said processor;

adding said updated dispense value to said accumulated dispense value to produce an updated accumulated dispense value, using said processor;

comparing said updated accumulated dispense value with a time limit, using said processor; and activating a toner dispense motor for said time limit and subtracting said time limit from said updated accumulated dispense value, using said processor, when said updated accumulated dispense value exceeds said time limit.

2. The computer-implemented method according to claim 1, said at least one control loop element comprising a pixel counter dispense loop.

3. The computer-implemented method according to claim 1, said at least one control loop element comprising a toner concentration (TC) sensor dispense control loop.

4. The computer-implemented method according to claim 1, said optimized limit gain including a user defined and optimized value for a specific developer housing.

5. The computer-implemented method according to claim 1, said toner dispense motor comprising a DC motor operating under control of said updated accumulated dispense value.

6. The computer-implemented method according to claim 1, said computer readable storage medium being decoupled from and operating asynchronously from said at least one control loop element.

7. A computer-implement method comprising:

updating, by a computing device, an accumulated dispense value from within a toner dispense actuation loop;

adjusting, by said computing device, said accumulated dispense value by receiving dispense values from at least one control loop element that operates asynchronously from said toner dispense actuation loop;

one of, storing, by said computing device, a temporary accumulated dispense value equal to a predetermined dispense saturation upper limit when said accumulated dispense value is greater than or equal to said predetermined dispense saturation upper limit; and storing, by said computing device, said temporary accumulated dispense value equal to a predetermined dispense saturation lower limit when said accumulated dispense value is less than or equal to said predetermined dispense saturation lower limit;

calculating, by said computing device, an adjusted accumulated dispense value by subtracting said accumulated dispense value from said temporary accumulated dispense value and multiplying the difference by a predetermined optimized limit gain;

determining, by said computing device, a new accumulated dispense value by adding said adjusted accumulated dispense value to said accumulated dispense value; and activating a toner dispense motor for a time period equal to an on time value, and subtracting said on time value from said new accumulator value based on determining, by said computing device, when said new accumulated dispense value is greater than or equal to said on time value.

8. The computer-implement method according to claim 7, said updating of said accumulated dispense value being performed at a first frequency.

9. The computer-implement method according to claim 7, said toner dispense motor comprising a DC motor located within a developer housing of a printing engine.

10. The computer-implement method according to claim 7, said at least one control loop element comprising at least one of:

a pixel counter dispense control loop transmitting dispense values to update said accumulated dispense value at a second frequency; and a toner control sensor dispense control loop transmitting dispense values to update said accumulated dispense value at a third frequency.

11. The computer-implement method according to claim 10, said second frequency being equivalent to processing each received image panel, and said third frequency being equivalent to a predetermined period of time.

12. The computer-implement method according to claim 10, said pixel counter dispense control loop transmitting said dispense values equivalent to a pixel time value equal to a product of a pixel counter value and a pixel gain value.

13. The computer-implement method according to claim 10, said toner control sensor dispense control loop transmitting said dispense values equivalent to a toner control sensor time value equal to the sum of a proportional gain component of an error signal and an integral gain component of said error signal.

14. A printing device comprising:

a toner concentration (TC) controller that has a dispense time accumulator buffer;

at least one control loop that transmits a dispense value to one of increment and decrement said dispense time accumulator buffer;

a toner dispense actuation loop that controls a toner dispense motor based on updating a value of said dispense time accumulator buffer; and a developer housing that includes said toner dispense motor, toner, a developer and a toner concentration (TC) sensor for a printing engine, said at least one control loop comprising a toner concentration (TC) sensor dispense control loop that generates said dispense value based on said toner concentration (TC) sensor in said developer housing by summing a proportional gain component of an error signal with an integral gain component of said error signal.

15. The printing device according to claim 14, said at least one control loop comprising a pixel counter dispense loop that generates said dispense value based on a pixel counter element equal to a product of a pixel counter value with a pixel gain value.

16. The printing device according to claim 14, said toner dispense actuation loop updating said value of said dispense time accumulator buffer at a first frequency different from at least one second frequency of said at least one control loop transmitting said dispense value to one of increment and decrement said dispense time accumulator buffer.

17. The printing device according to claim 14, said toner dispense motor comprising a DC motor.

18. The printing device according to claim 14, wherein said printing engine comprises one of an electrostatic and a xerographic printing engine.

19. A printing device comprising:

a toner concentration (TC) controller that has a dispense time accumulator buffer;

at least one control loop that transmits a dispense value to one of increment and decrement said dispense time accumulator buffer;

a toner dispense actuation loop that controls a toner dispense motor based on updating a value of said dispense time accumulator buffer; and a developer housing that includes said toner dispense motor, toner, a developer and a toner concentration (TC) sensor for a printing engine;

said toner concentration (TC) controller calculates an adjusted dispense time accumulator buffer value by determining a difference between said dispense time accumulator buffer value and one of an upper and a lower saturation limit, by determining a product by multiplying said difference by a predetermined optimized limit gain value, and by determining a sum of adding said product to said dispense time accumulator buffer value.

* * * * *